US007013769B2

(12) United States Patent
Chen

(10) Patent No.: US 7,013,769 B2
(45) Date of Patent: Mar. 21, 2006

(54) TORQUE ADJUSTABLE SCREW DRIVER

(76) Inventor: Chang-Ying Chen, No. 5, Alley 320, Shi-Hu Rd., Ta-Li Hsiang, Taichung Hsien (TW)

( * ) Notice: Subject to any disclaimer, the term of this patent is extended or adjusted under 35 U.S.C. 154(b) by 181 days.

(21) Appl. No.: 10/804,050

(22) Filed: Mar. 19, 2004

(65) Prior Publication Data

US 2005/0204876 A1 Sep. 22, 2005

(51) Int. Cl.
*B25B 23/157* (2006.01)

(52) U.S. Cl. ..... 81/473; 81/467; 81/475; 81/476

(58) Field of Classification Search ..... 81/473–476, 81/467

See application file for complete search history.

(56) References Cited

U.S. PATENT DOCUMENTS 5,737,982 A * 4/1998 Lin ..... 81/58.3
5,813,298 A * 9/1998 Beattie ..... 81/475
6,339,977 B1 * 1/2002 Lee et al. ..... 81/58.3
6,349,625 B1 * 2/2002 Poganski ..... 81/475
6,912,934 B1 * 7/2005 Liao ..... 81/58.3
2005/0193870 A1 * 9/2005 Chen ..... 81/58.4

* cited by examiner

*Primary Examiner*—Hadi Shakeri

(57) ABSTRACT

A torque adjustable screw driver includes a handle and a shank connected to an end of the handle. Two disks are mounted to the shank and each have an inclined end surface. The two respective inclined end surfaces contact each other and one of which includes protrusions and the other has grooves which are sized to receive the protrusions. A sleeve is mounted to the shank and a spring is biased between the inner bottom of the sleeve and the two disks so that the two disks can be rotated from each other when the torque is large enough to make the two disks have relative rotational movement. The required torque can be adjusted by rotating one of the two disks to push the other disk to compress the spring.

8 Claims, 4 Drawing Sheets

TORQUE ADJUSTABLE SCREW DRIVER

FIELD OF THE INVENTION

The present invention relates to a screw driver and the output torque of the screw driver can be adjustable.

BACKGROUND OF THE INVENTION

A conventional screw driver generally includes a handle and a shank which includes a polygonal recess defined in a distal end thereof so as to receive screw bits. The user rotates the handle to output a torque from the screw bit so as to tighten or loosen a bolt or a screw. The output torque of the conventional screw driver cannot be controlled so that the conventional screw driver cannot be used on some machines that require precise torque for the screws. Although some screw drivers have the feature of adjustable torque, most of them have a common shortcoming which is that the screw driver provides a fixed resistance and this is obviously not satisfied for the users.

The present invention intends to provide a screw driver that includes several torques to be chosen and the user may fix the screw driver at a specific position which provides a pre-set amount of torque.

SUMMARY OF THE INVENTION

The present invention relates to a torque adjustable screw driver which comprises a handle and a shank having a polygonal section is connected to the handle. A first disk is rotatably connected to an end of the handle and has a first inclined end surface defined in a top thereof. A plurality of protrusions extend from the first inclined end surface. A second disk has a second inclined end surface defined in a bottom thereof. A plurality of grooves are defined in the second inclined end surface and the second inclined end surface contact the first inclined end surface.

A sleeve is mounted to the first and second disks and a board assembly is rotatably engaged with an inner periphery of the sleeve. A spring is biased between the second disk and the board assembly. The first section of the shank rotatably extends through a first hole in a close top of the sleeve and securely extends through a polygonal hole defined through the board assembly. A distal end of the first section extends through the spring, a second hole in the second disk, a third hole in the first disk and being fixed to the handle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figures 1, 2:
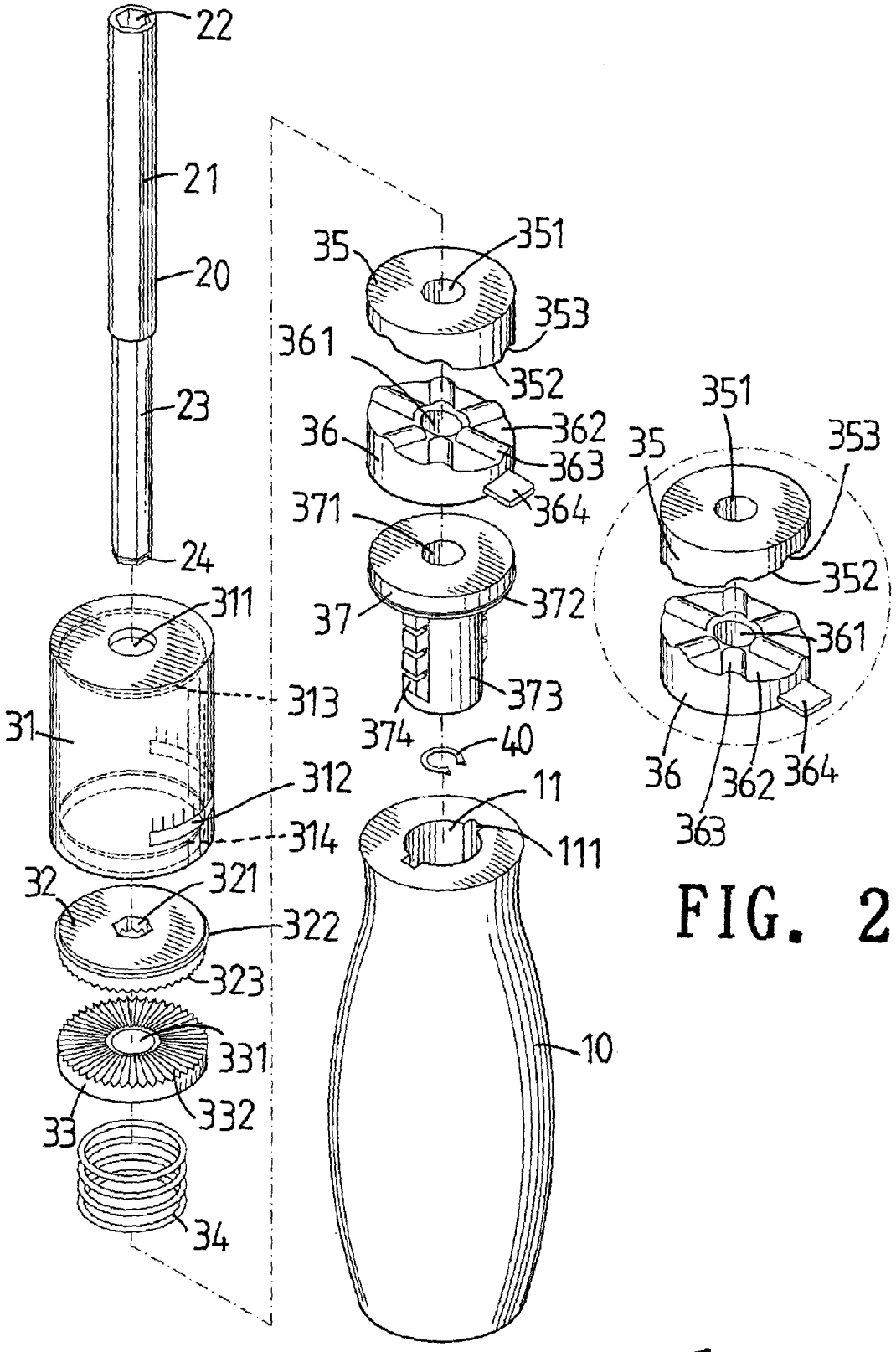
FIG. 1 is an exploded view to show the screw driver of the present invention.
FIG. 2 shows the two disks are rotated relative to each other an angle.
Figure 3:
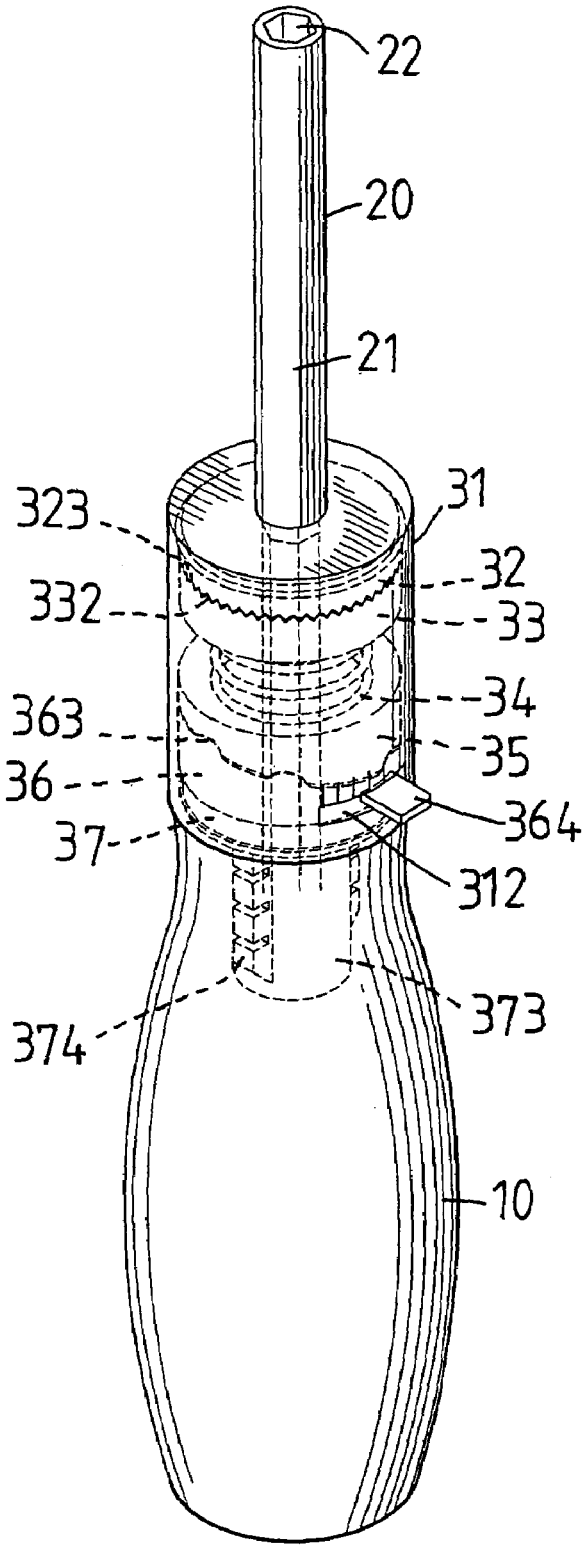
FIG. 3 shows a perspective view of the screw driver of the present invention.

Referring to FIGS. 1 to 3, the torque adjustable screw driver of the present invention comprises a handle 10 that has a recess 11 defined in an end thereof and two side slots 111 are in communication with the recess 11 of the handle 10. An end member 37 includes a top board and an insertion 373 which is inserted in the recess 11 in the handle 10. A passage 371 is defined through the end member 37 and two wings 374 extend from an outer periphery of the insertion 373 so as to be inserted in the two side slots 111.

A first disk 36 is rotatably connected to the top board which is located at an end of the handle 10 and the first disk 36 has a first inclined end surface 362 defined in a top thereof. A plurality of protrusions 363 extend from the first inclined end surface 362. A second disk 35 has a second inclined end surface 352 defined in a bottom thereof and a plurality of grooves 353 are defined in the second inclined end surface 352. The second inclined end surface 352 of the second disk 35 contacts the first inclined end surface 362 of the first disk 36. The grooves 353 are sized to engage with the protrusions 363 when the two disks 36, 35 have relative movement.

A sleeve 31 is mounted to the first and second disks 36, 35 and a board assembly is rotatably engaged with an inner periphery of the sleeve 31. A spring 34 is biased between the second disk 35 and the board assembly. The board assembly includes a first board 32 and a second board 33. The first board 32 has a toothed bottom surface 323 and the second board 33 has a toothed top surface 332 which is matched with the toothed bottom surface 323 of the first board 32. The sleeve 31 includes a slot 312 defined through a wall thereof and the first disk 36 has an extension 364 extending radially therefrom. The extension 364 extends through the slot 312 of the sleeve 31 so that the user may shift the extension 364 to rotate the first disk 36. The sleeve 31 includes a first engaging groove 313 defined in an inner periphery thereof and the first board 32 of the board assembly includes a flange 322 on an outer periphery thereof. The flange 322 of the first board 32 is rotatably engaged with the first engaging groove 313. The top board of the end member 37 has another flange 372 which is engaged with a second engaging groove 314 defined in the inner periphery of the sleeve 31.

A shank 20 has a first section 23 with a polygonal cross section and a second section 21 having a circular cross section. A polygonal recess 22 is defined in a distal end of the second section 21 so as to receive bit (not shown) therein. The first section 23 rotatably extends through a first hole 311 in a close top of the sleeve 31 and securely extends through a polygonal hole 321 defined through the first board 32 of the board assembly, a through hole 331 in the second board 33, the spring 34, a second hole 351 in the second disk 35, a third hole 361 in the first disk 36, the passage 371 in the end member 37 and being fixed to the handle 10. The distal end of the first section 23 that extends through the passage 371 in the end member 37 is fixed by a C-shaped clip 40.

It is noted that an outer diameter of the second section 21 of the shank 20 is larger than an inner diameter of the first hole 311 of the sleeve 31, so that the second section 21 of the shank 20 will not go through the first hole 311 of the sleeve 31.

Figure 4:
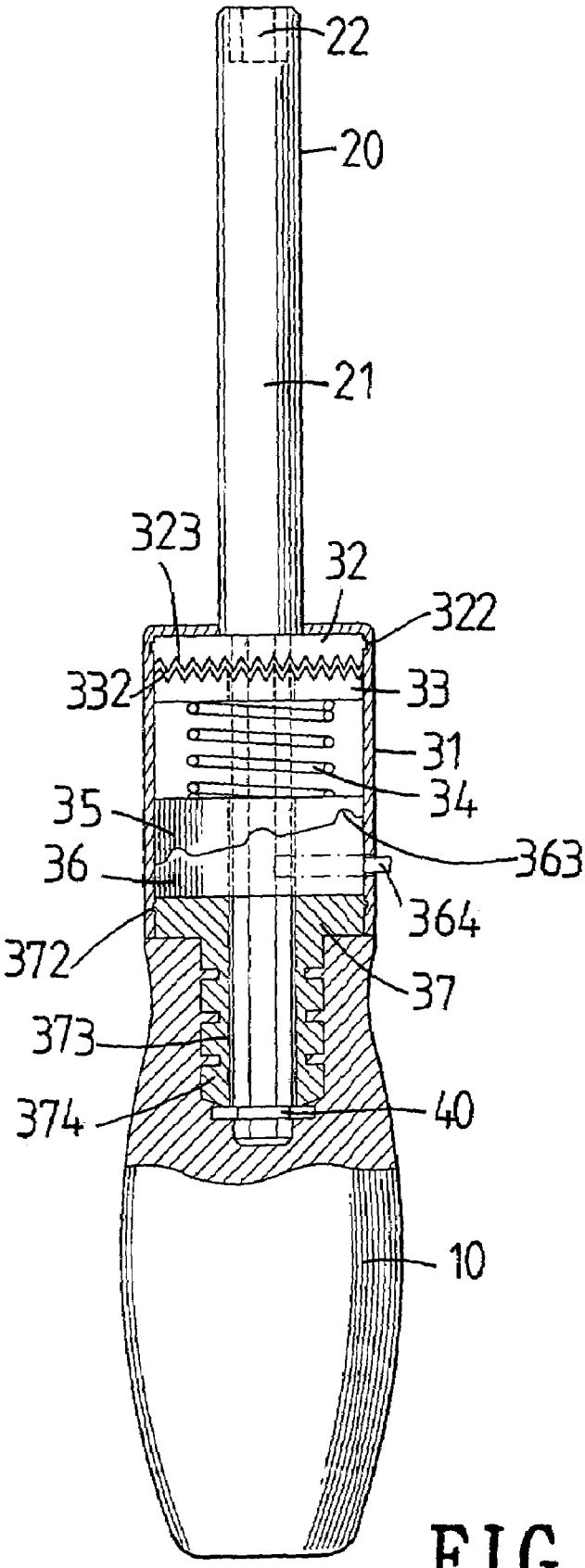
FIG. 4 is a cross sectional view to show the screw driver of the present invention, wherein the second disk is located at a lower position.
Figure 5:
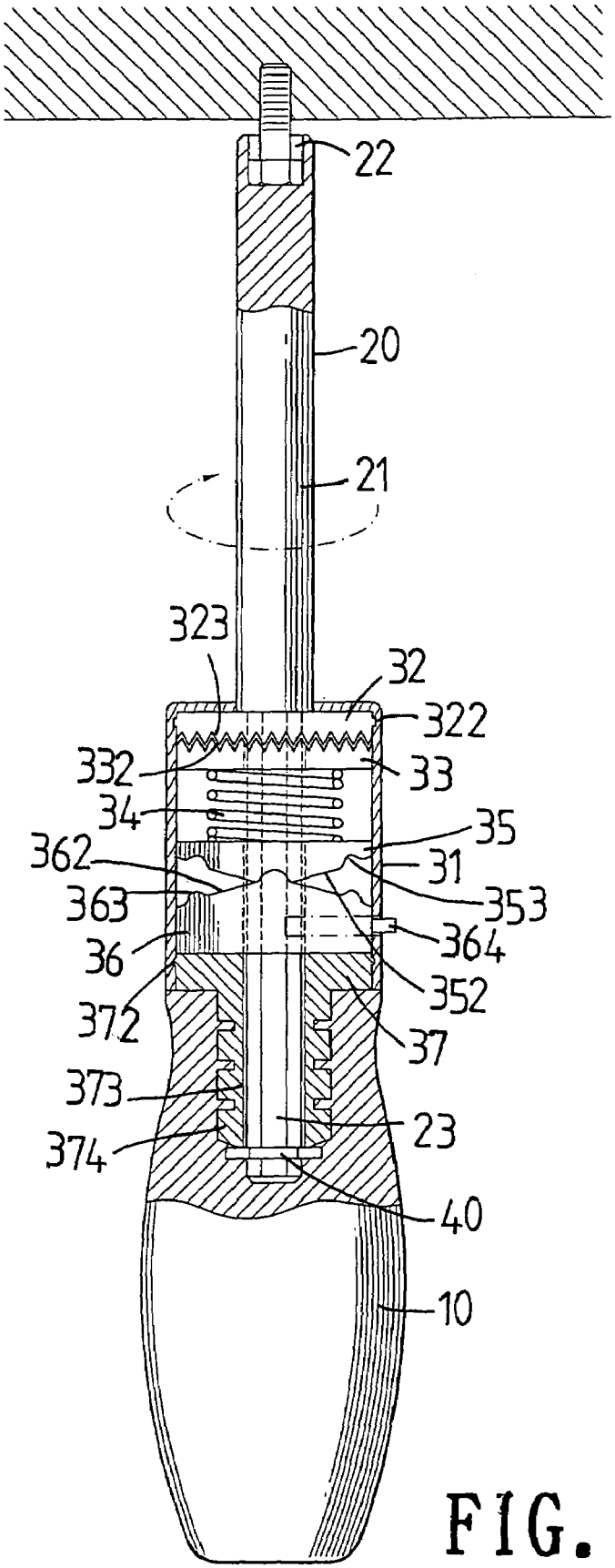
FIG. 5 is a cross sectional view to show the screw driver of the present invention, wherein the second disk is located at a higher position.

Referring to FIG. 4, when the user shifts the extension 364 of the first disk 36 to let the first inclined end surface 352 match with the second inclined end surface 352. At this position, the second disk 35 is located at a lower position and the spring 34 applies less force to the second disk 35. Therefore, when tightening a nut or a screw, a lower torque may rotate the second disk 35 relative to the first disk 36. When the second disk 35 rotates an angle, the user feels a click sound by any one of the protrusions 363 re-entering another groove 353. As shown in FIG. 5, when the user shifts the extension 364 of the first disk 36 to let the peak area of the first inclined end surface 352 contact the peak area of the second inclined end surface 352. At this position, the second disk 35 is located at a higher position and the spring 34 applies a larger force to the second disk 35. Therefore, when tightening a nut or a screw, a higher torque can rotate the second disk 35 relative to the first disk 36. Again, a click sound reminds the user that the higher torque is reached.

While we have shown and described the embodiment in accordance with the present invention, it should be clear to those skilled in the art that further embodiments may be made without departing from the scope of the present invention.

What is claimed is:

1. A torque adjustable screw driver comprising:

a handle;

a first disk rotatably connected to an end of the handle and having a first inclined end surface defined in a top thereof, a plurality of protrusions extending from the first inclined end surface;

a second disk having a second inclined end surface defined in a bottom thereof, a plurality of grooves defined in the second inclined end surface, the second inclined end surface contacting the first inclined end surface;

a sleeve mounted to the first and second disks and a board assembly rotatably engaged with an inner periphery of the sleeve, a spring biased between the second disk and the board assembly, and a shank having a first section with a polygonal cross section, the first section rotatably extending through a first hole in a close top of the sleeve and securely extending through a polygonal hole defined through the board assembly, a distal end of the first section extending through the spring, a second hole in the second disk, a third hole in the first disk and being fixed to the handle.

2. The screw driver as claimed in claim 1, wherein the sleeve includes a slot defined through a wall thereof and the first disk has an extension extending radially therefrom, the extension extending through the slot of the sleeve.

3. The screw driver as claimed in claim 1, wherein the board assembly includes a first board and a second board, the polygonal hole defined through the first board which has a toothed bottom surface, the second board having a fourth hole and a toothed top surface which is matched with the toothed bottom surface of the first board.

4. The screw driver as claimed in claim 1, wherein the sleeve includes a first engaging groove defined in an inner periphery thereof and the board assembly includes a flange on an outer periphery thereof, the flange of the board assembly rotatably engaged with the first engaging groove.

5. The screw driver as claimed in claim 1 further comprising an end member which includes a top board and an insertion which is inserted in a recess defined in the handle, the first disk rotatably put on a top surface of the top board, a passage defined through the end member and the first section of the shank extending through the passage and being fixed by a C-shaped clip.

6. The screw driver as claimed in claim 5 further comprising two side slots which communicate with the recess of the handle, the insertion having two wings which are inserted in the two side slots.

7. The screw driver as claimed in claim 1 further comprising a second section having a circular cross section and a polygonal recess defined in a distal end of the second section.

8. The screw driver as claimed in claim 7, wherein an outer diameter of the second section of the shank is larger than an inner diameter of the first hole of the sleeve.

* * * * *